US011470410B1

(12) United States Patent
D'Ascanio et al.

(10) Patent No.: US 11,470,410 B1
(45) Date of Patent: Oct. 11, 2022

(54) SPEAKER MOUNTING SYSTEM AND METHOD OF MOUNTING WITHIN A PANEL

(71) Applicants: Franco L D'Ascanio, Key Colony Beach, FL (US); Sean P Snowden, Marathon, FL (US); Igor Levitsky, Richmond Hill (CA); Franco C D'Ascanio, Key Colony Beach, FL (US); Harold M Zimmermann, Riverton, NJ (US)

(72) Inventors: Franco L D'Ascanio, Key Colony Beach, FL (US); Sean P Snowden, Marathon, FL (US); Igor Levitsky, Richmond Hill (CA); Franco C D'Ascanio, Key Colony Beach, FL (US); Harold M Zimmermann, Riverton, NJ (US)

(73) Assignee: COASTAL SOURCE, LLC, Marathon, FL (US)

( * ) Notice: Subject to any disclaimer, the term of this patent is extended or adjusted under 35 U.S.C. 154(b) by 0 days.

(21) Appl. No.: 17/663,480

(22) Filed: May 16, 2022

Related U.S. Application Data

(60) Provisional application No. 63/189,275, filed on May 17, 2021.

(51) Int. Cl.
*H04R 1/02* (2006.01)

(52) U.S. Cl.
CPC ..... *H04R 1/025* (2013.01); *H04R 2201/021* (2013.01); *H04R 2201/029* (2013.01)

(58) Field of Classification Search
CPC ..... H04R 1/025; H04R 2201/021; H04R 2201/029
See application file for complete search history.

(56) References Cited

U.S. PATENT DOCUMENTS 5,859,917 A * 1/1999 Silber ..... H04R 9/02 181/150
6,002,780 A * 12/1999 Espiritu ..... H04R 1/20 381/387
6,038,326 A * 3/2000 Czerwinski ..... H04R 1/26 381/342
6,101,262 A * 8/2000 Haase ..... H04R 1/345 381/387
6,356,640 B1 * 3/2002 Lin ..... H04R 1/323 381/387
7,861,825 B2 * 1/2011 Stewart, Jr. ..... H04R 1/2865 381/345
8,224,014 B2 * 7/2012 Sprinkle ..... H04R 1/345 381/387

(Continued)

*Primary Examiner* — Oyesola C Ojo

(57) ABSTRACT

An elliptically shaped speaker has a driver assembly which may include a woofer driver and a tweeter driver. The speaker has a uniquely designed bridge member. The bridge member acts both as a structural element and waveguide for the tweeter. It has a specific elongated, elliptical shape that allows the speaker to be inserted into a corresponding cut-out opening in a wall, ceiling or any other structural panel, then rotated behind the panel and re-inserted from behind into the opening, thereby providing a secure seal and exact positioning within the panel. The resulting system allows for a low frequency speaker to be installed behind the panel with a noticeably smaller opening than the total size of the speaker.

9 Claims, 4 Drawing Sheets

(56) References Cited

U.S. PATENT DOCUMENTS

| | | | | |
|---|---|---|---|---|
| 8,325,965 | B2 * | 12/2012 | Blackmon | H04R 1/345 381/387 |
| 9,743,164 | B2 * | 8/2017 | McLean | H04R 1/025 |
| 9,800,976 | B2 * | 10/2017 | Honda | H04R 1/345 |
| 10,911,849 | B2 * | 2/2021 | Ivey | H04R 27/00 |
| 10,966,016 | B2 * | 3/2021 | Lee | H04R 1/345 |
| 11,128,947 | B2 * | 9/2021 | Darling | H04R 1/021 |
| 2003/0183443 | A1 * | 10/2003 | Busque | H04R 7/045 181/173 |
| 2004/0125974 | A1 * | 7/2004 | Kosatos | H04R 1/323 381/335 |
| 2004/0159490 | A1 * | 8/2004 | Marlin | H04R 9/02 181/148 |
| 2004/0179710 | A1 * | 9/2004 | Farinelli, Jr. | H04R 1/025 181/150 |
| 2005/0263341 | A1 * | 12/2005 | Minneci | H04R 1/025 181/154 |
| 2008/0056516 | A1 * | 3/2008 | Christian | H04R 1/227 381/303 |
| 2011/0019862 | A1 * | 1/2011 | Smith | H04R 1/2842 381/386 |
| 2011/0164774 | A1 * | 7/2011 | Gladwin | H04R 5/02 29/896.2 |
| 2013/0011001 | A1 * | 1/2013 | Fujimori | H04R 1/025 381/413 |
| 2019/0246202 | A1 * | 8/2019 | Winton | H04R 1/2803 |

* cited by examiner

SPEAKER MOUNTING SYSTEM AND METHOD OF MOUNTING WITHIN A PANEL

RELATED APPLICATION

This application claims the benefit of provisional application Ser. No. 63/189,275, filed on May 17, 2021.

FIELD OF THE INVENTION

The present invention relates to speakers and speaker mounting systems and the method of mounting and installing these drivers into any stationary panel, i.e. a ceiling or wall.

BACKGROUND OF THE INVENTION

The installation of speakers in the ceiling or in the wall has been very popular for years. It allows discrete positioning that does not take up floor space and almost an invisible placement inside living environment. It also adds certain acoustic benefits, such as enhanced bass, due to isolation of sound radiated from the rear of the speaker (half-space acoustic loading).

Speaker designers have tried to minimize the visible size of grilles and the cut-outs required for installation. In a typical design, the size of the grille will be larger than the size of the speaker, thereby exacerbating the visual appearance. However, a larger speaker will typically exhibit better performance. It can play louder, with more bass output. Thus, better performance and a desire for minimal visual obstruction are always opposing factors.

In order to overcome speaker performance limitations while retaining small visible panel opening, several products use a "band pass" design. This concept utilizes a large woofer driver installed above the panel that is intended for new construction installations. After the driver is installed within a cavity, a panel with a smaller opening is installed in front of it. A much smaller mid-high frequency driver is installed within this small opening, obstructing it, and allowing for only a very narrow circular opening for low frequency sound to exit from the woofer. Although such a solution produces a design with a relatively small visible aperture, it has significant drawbacks. This mounting method does not allow easy access or service of the woofer driver. One has to remove the entire panel to replace the woofer. In addition, there are acoustic problems related to the very narrow opening for low frequency radiation and the need to have the coaxially placed driver to reproduce not only high frequency, but also the mid-frequency band.

SUMMARY OF THE INVENTION

It is thus the object of the present invention to provide a speaker mounting system and method of mounting a speaker within a panel which overcomes the disadvantages and limitations of prior systems and methods.

It is the primary object of the present invention to provide a speaker panel mounting system and method for mounting which utilizes a relatively small panel opening in the mounting of a larger speaker within the opening, thereby minimizing the visual appearance of the speaker assembly, including its grille, while maintaining the benefit of a larger speaker and the enhanced sound such a speaker produces.

These and other objects are accomplished by the present invention, a unique speaker having an elongated shape, either elliptical or "racetrack," and its unique method of installation into a panel. The speaker comprises a driver assembly, which includes a low frequency woofer driver and a high frequency tweeter driver that is positioned in front of the woofer, and a specially designed bridge member. The bridge member functions as a structural element and waveguide for the tweeter. Like the speaker itself, the bridge also has a specific elongated, elliptical shape that allows the speaker to be inserted into a corresponding cut-out opening in a panel, then rotated behind the panel and re-inserted from behind into the opening, thereby providing a secure seal and exact positioning within the panel. The resulting system allows for a speaker to be installed behind the panel with a noticeably smaller opening than the total size of the speaker.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 2:
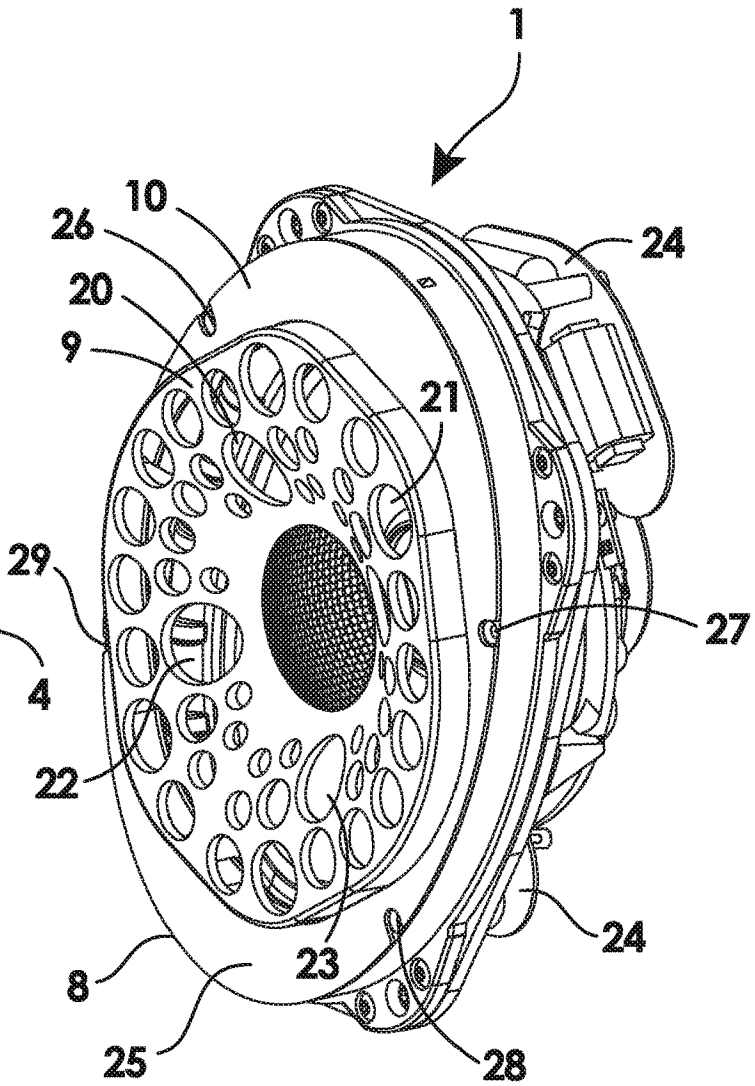
FIG. 2 is a top perspective view of the speaker of the present invention.
Figure 1:
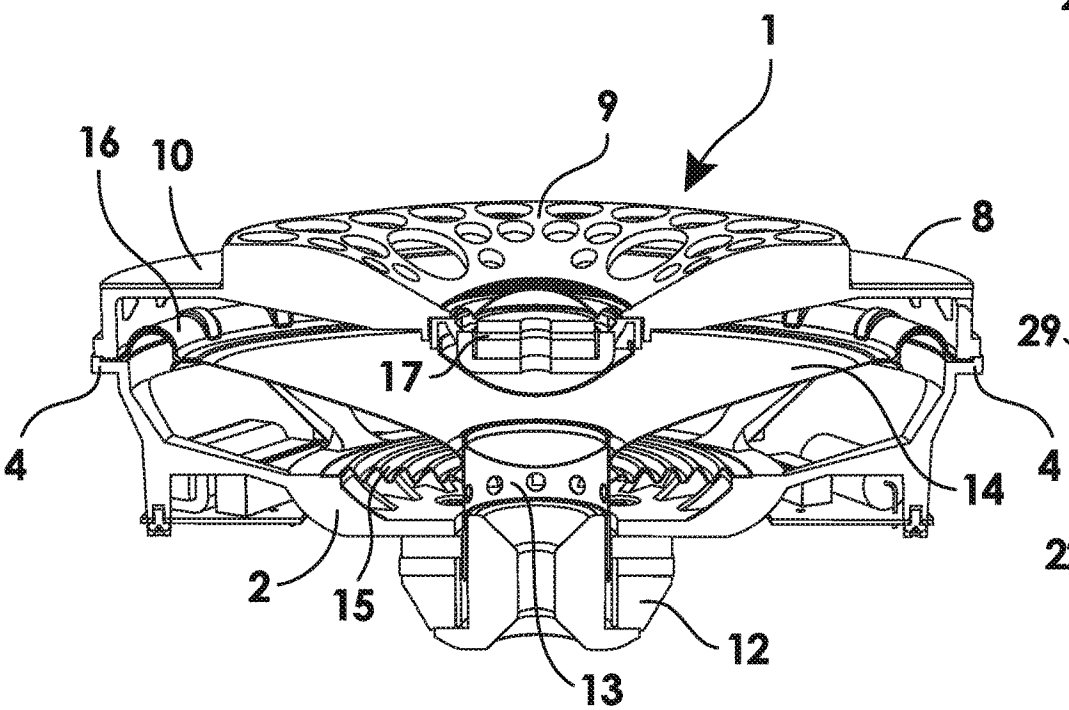
FIG. 1 shows a cross-sectional view of the speaker of the present invention.

With reference to FIGS. 1 and 2, elongated, elliptically shaped speaker 1 comprising elliptically shaped frame 2 having distal ends 4. Frame 2 underlies and supports a driver assembly comprising low frequency woofer driver 7 and high frequency tweeter driver 17. More specifically, frame 2 carries magnet system 12 which produces a magnetic flux field. Voice coil 13 is disposed inside magnet system 12 and is attached to woofer cone 14 at the top and to spider 15 (suspension element made out of thermoformed flexible fabric material) in the middle. Surround 16, made out of an elastomeric material, acts as a suspension element for woofer cone 14. Tweeter 17 is disposed in front of woofer cone 14.

The present invention should not be considered restricted to driver assemblies comprising woofer and tweeter drivers. It is contemplated that the herein system and method can apply to other driver configurations, i.e. to a coaxial driver, full range driver, or subwoofer driver, among others.

Bridge member 8, positioned on frame 2, comprises center section 9 and lateral region 10 which circumscribes the center section and extends outwardly from the center section to distal ends 4 of frame 2. Bridge member 8 serves as a structural component and as an acoustic waveguide for tweeter 17.

Center section 9 of bridge member 8 is upraised from lateral region 10 and only the center section, and not the lateral region, overlays the driver assembly: i.e. woofer driver 7 and tweeter driver 17. Center member 9 is mostly acoustically transparent at low and mid frequencies. At high frequencies, however, it acts as a waveguide for tweeter 17, due to partial perforation of its surface. Other variations of perforation pattern are possible. Holes 26, 27, 28, and 29 are disposed on bridge member 8 for speaker mounting.

Four large openings 20, 21, 22, and 23, symmetrically disposed around tweeter 17, serve for handling and positioning of speaker 1 by the insertion of one's fingers. Sections of electric crossover network 24 are disposed on the frame and serve to divide electric signal into low frequency and high frequency bands for woofer driver 7 and for tweeter driver 17 respectively. Gasket 25 provides an air tight seal for interface between speaker 1 and panel 30.

Figure 5:
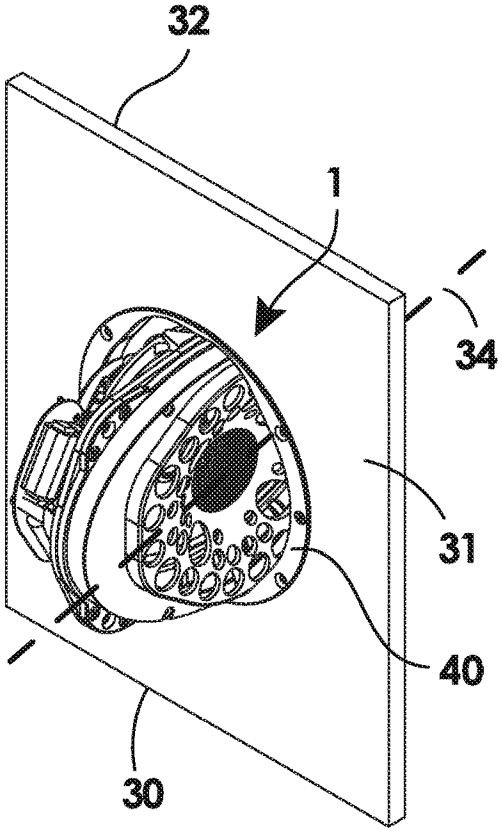
FIGS. 3-7 illustrate the steps of the method of the present invention.
Figure 4:
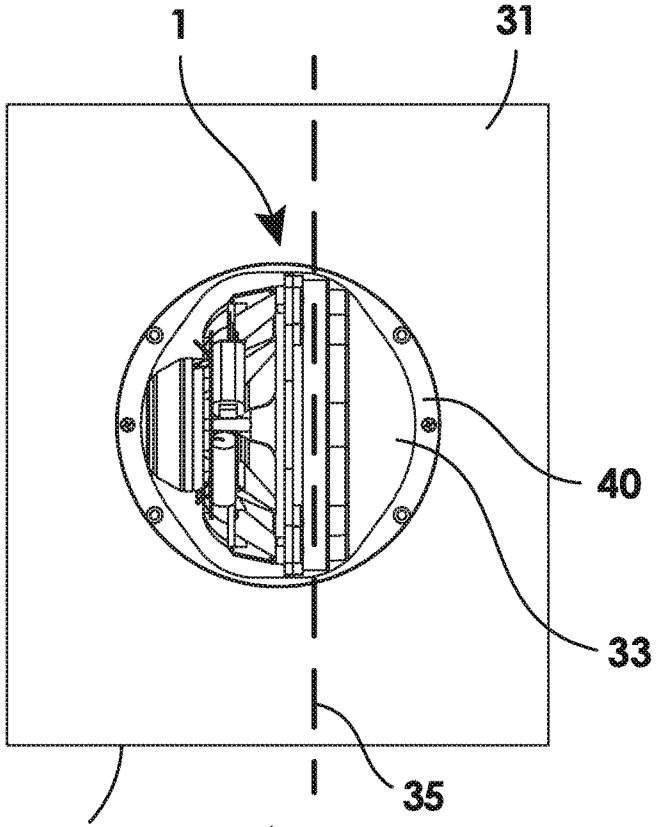
Figure 3:
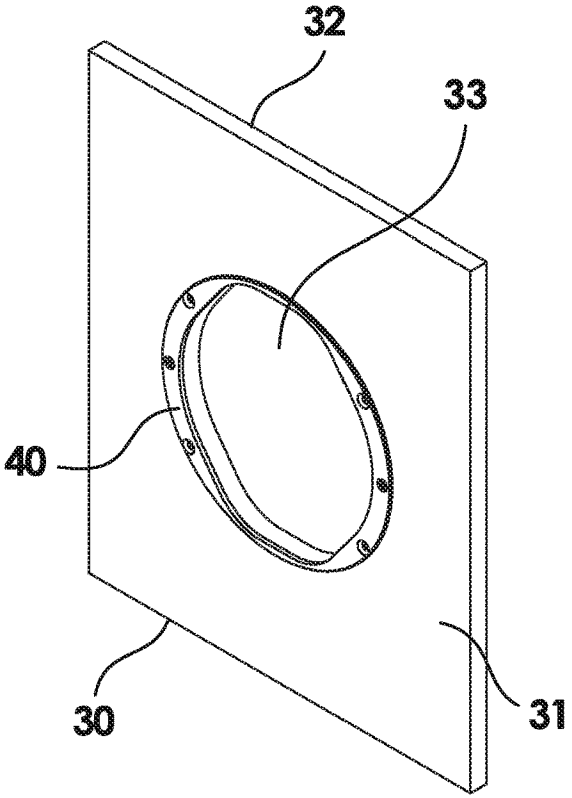

With reference to FIG. 3, panel 30, having front surface 31 and rear surface 32, is a typical surface. Opening 33 is cut through panel 30 using any board cutting tool and a template. The size and shape of opening 33 is the same as the size and shape of center section 9 of bridge member 8. Before insertion of driver 1 into panel 30, a speaker wire (behind the panel) is connected to input terminals of the crossover network 23. Speaker 1 is then oriented "sideways", as shown in FIGS. 4 and 5, with its vertical elliptical axis 34 perpendicular to surfaces 31 and 32 of panel 30 and its shorter horizontal elliptical axis 35 oriented parallel to surfaces 31 and 32 of panel 30. Speaker 1 is next inserted into opening 33, through front surface 31 in the direction of and toward rear surface 32.

After speaker 1 is connected to the speaker wire and inserted through opening 33, it is positioned behind panel 30 and rotated such that center section 9 matches the shape of opening 33. From behind, speaker 1 is then inserted into the opening 33 and pulled in tightly toward rear surface 32 for proper fitting.

Figure 6:
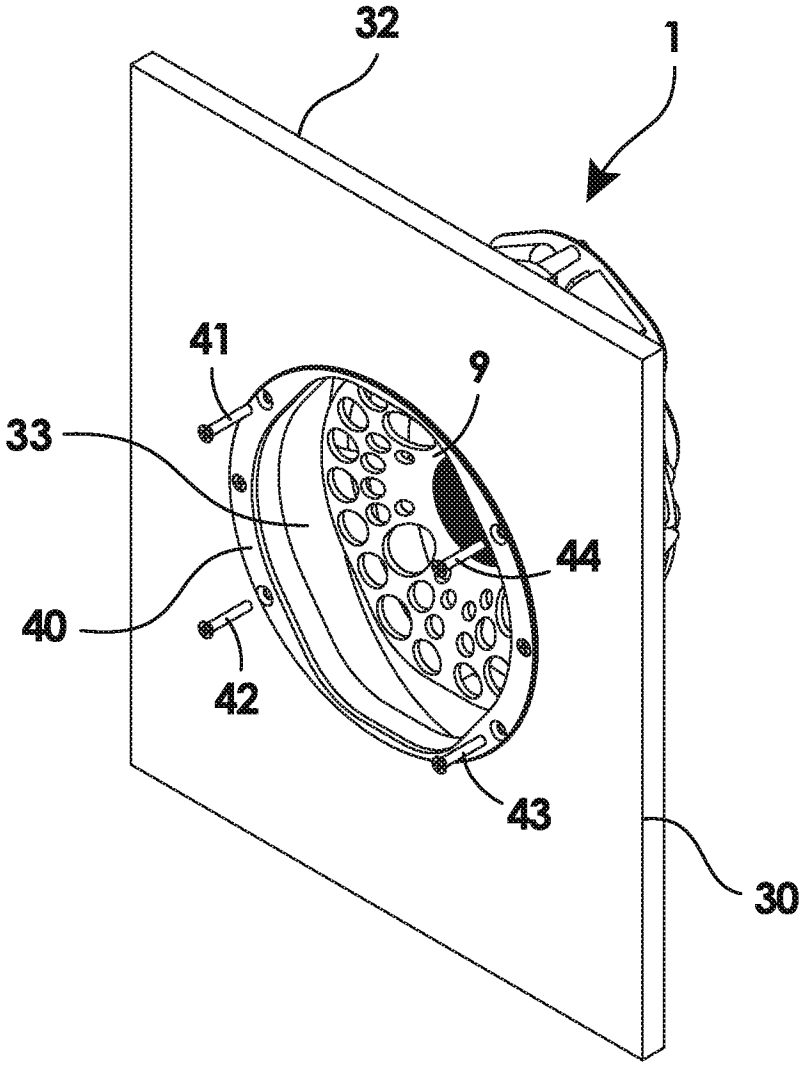

Trim ring 40 is provided on front surface 31, around opening 33. Speaker 1 and trim ring 40 are attached for mounting to panel 30 by means of screws 41, 42, 43, and 44 through holes 26, 27, 28, and 29. See FIGS. 6 and 7.

Figure 7:
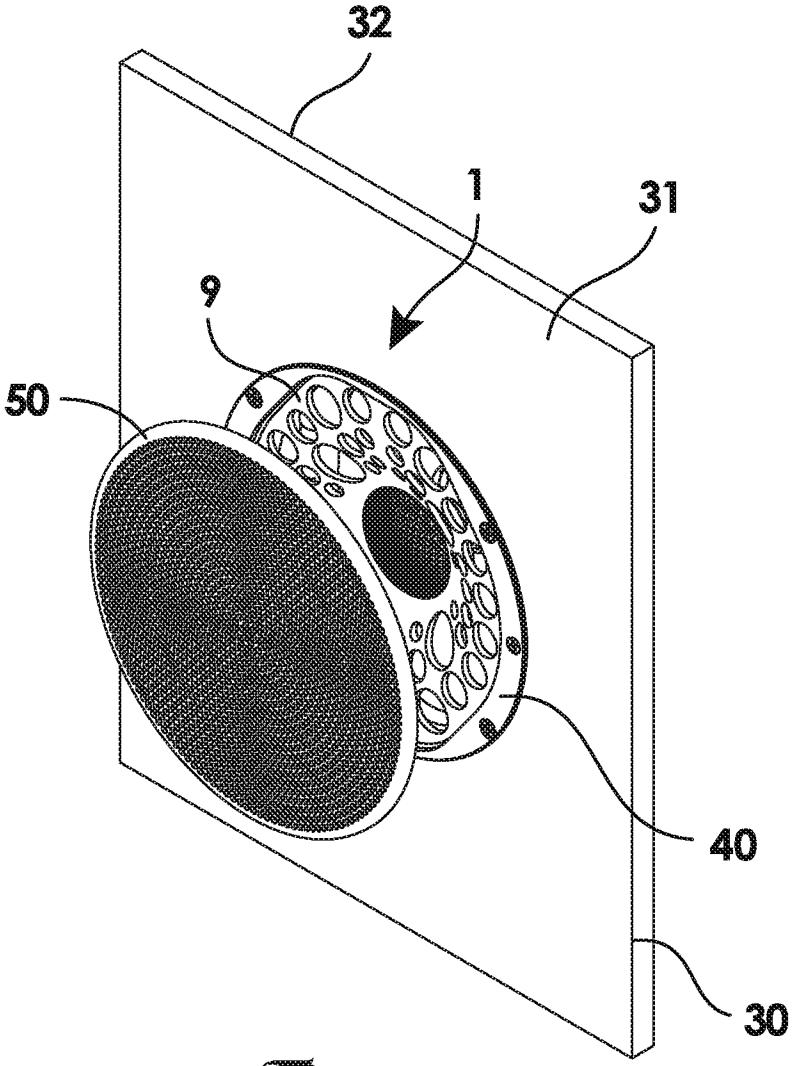

By this system and method of the present invention, speaker 1 is securely mounted in panel 30 with only center section 9 of bridge member 8 extending through opening 33, the driver assembly, comprising woofer driver 7 and tweeter driver 17, and lateral region 10 being positioned behind and extending outwardly from rear surface 32 of the panel. As a final step, perforated cosmetic grille 50 is installed over trim ring 40, as seen in FIG. 7. A snap-in grille is contemplated.

Other grille shapes and mounting solutions are possible. Those referenced above and some other variations of mounting grille 50 to center section 9 of bridge member 8 with a depth adjustable feature, would allow clean, minimal opening installation.

Figure 8:
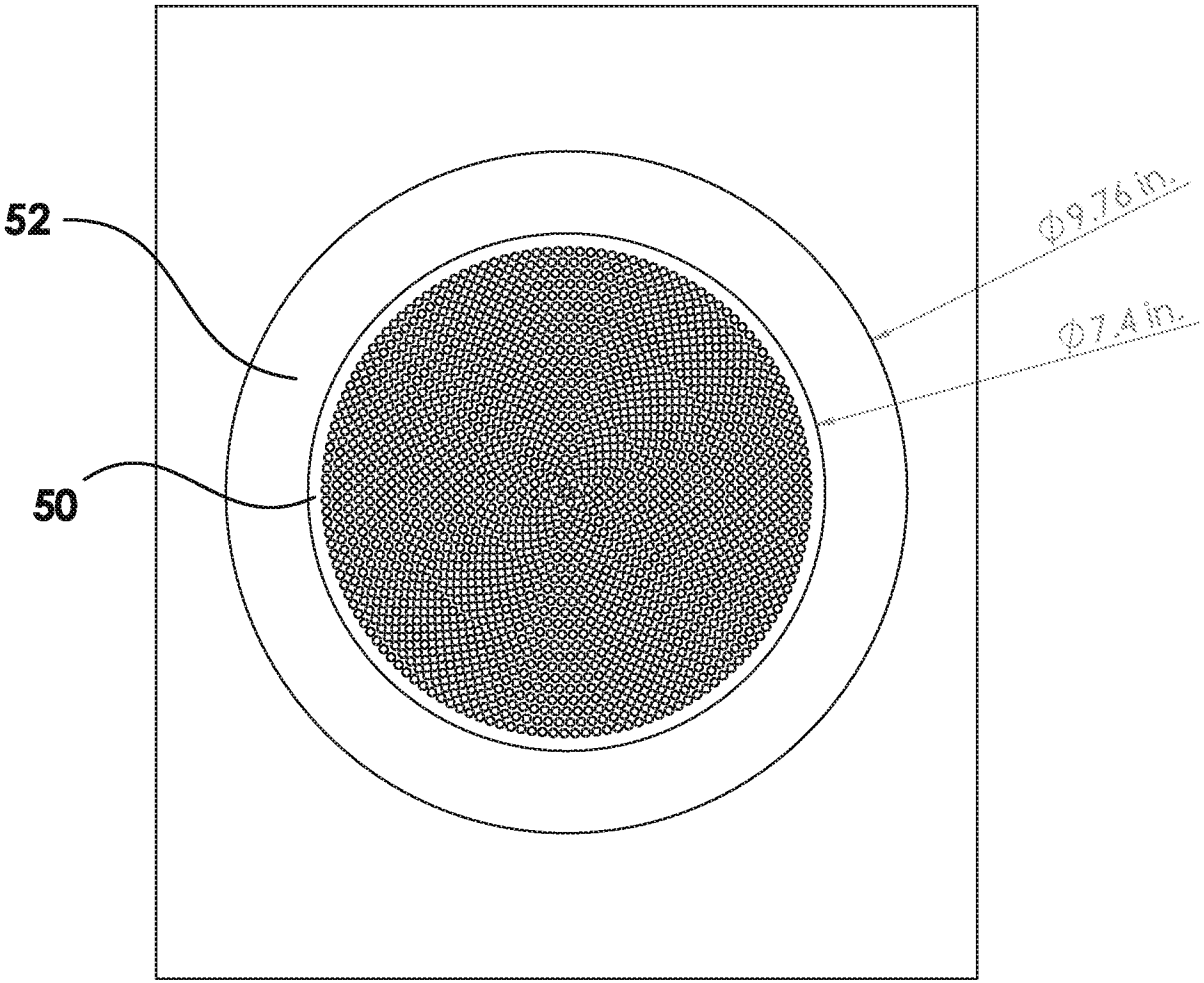
FIG. 8 shows the speaker installed within the panel and a comparison to a traditional ceiling speaker grille.

FIG. 8 shows the size of grille 50 compared to the size of a typical, prior ceiling speaker grille 52, in which the round speaker has the same effective cone area. A 6×9" elliptical speaker, utilized in the invention and illustrated in FIG. 8, has the equivalent cone area of 42.4 sq. in. An equivalent round cone speaker with the same area has a diameter of 7.4". A typical speaker 52 with such a speaker will have a grille outside diameter of 9.76", also as shown on FIG. 8. The current invention allows the size reduction of grille 50 to a mere 7.16" with dramatic visual effect.

The novel features and resulting advantages of the present invention are as follows:

- The speaker has significantly larger equivalent surface size than visible grille size.
- Easy servicing and replacement of the speaker without damage to the panel structure.
- The absence of a speaker bezel in front of the panel allows for a much thinner, almost flush installation depth; only a grille with a few millimeters depth is required to cover the speaker.
- The unique acoustical advantage resulting from the combination of a low frequency acoustic filter and high frequency waveguide formed by a partially opened bridge.
- Unlike round drivers with round panel openings, the elliptical shape of the speaker effectively couples to dissimilar shape bridge member openings. This helps to disperse lower Q factor and integrate acoustic cavity resonances and edge diffraction effects into a smoother SPL.
- When installed standard ½"-⅝" thick panel, the high frequency waveguide edge is leveled almost flush with the cut-out front edge, leading to minimal diffraction effects at high frequency.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A speaker mounting system for the installation of a speaker into an opening in a panel, said system comprising:

a speaker comprising:

a driver assembly supported by an underlying frame; and a bridge member positioned on the frame, said bridge member having a center section of a given size and shape and a lateral region circumscribing the center section, the center section being upraised from the lateral region and the lateral region extending outwardly from the center section to the distal ends of the frame, wherein only the center section and not the lateral region overlays the driver assembly; and a flat panel comprising:

front and back panel surfaces and an opening extending through the panel, the opening having the same size and shape as the center section of the bridge member;

wherein the speaker is configured to be installed and mounted in the panel with only the center section of the bridge member extending through the opening and the driver assembly extending outwardly from the rear surface of and behind the panel.

2. A speaker mounting system as in claim 1 wherein the speaker has a vertical, elliptical axis and a horizontal, elliptical axis which is shorter than the vertical, elliptical axis.

3. A speaker mounting system as in claim 2 wherein the bridge member and its center section both have a vertical and horizontal, elliptical axii which are identical to the vertical and horizontal elliptical axii of the speaker.

4. A speaker mounting system as in claim 1 further comprising a trim ring for attaching the installed and mounted speaker to the front surface of the panel.

5. A method for installing a speaker in a panel, the steps of the method comprising:

providing a speaker having a driver assembly supported by an underlying frame and a bridge member positioned on the frame, the bridge member having a center section of a given size and shape and a lateral region circumscribing the center section which is upraised from the lateral region, the lateral region extending outwardly from the center section to the distal ends of the frame, wherein only the center section and not the lateral region overlays the driver assembly;

connecting the speaker to input terminals;

providing a flat panel having front and back panel surfaces;

cutting, through the panel, an opening having the same given size and shape as the center section;

inserting the speaker into the cut-out opening, through the front surface of the panel and in the direction of and toward the rear surface of the panel, such that the speaker is located behind the panel;

rotating and positioning the speaker such that the center section of the bridge member extends through and matches the given shape of the opening, and the driver assembly and the lateral region are located behind the rear surface of the panel; and attaching the speaker to the panel with its center section through the opening and the driver assembly and the lateral region behind the rear surface of the panel.

6. The method as in claim 5 wherein the speaker has a vertical, elliptical axis and a horizontal, elliptical axis which is shorter than the vertical elliptical axis.

7. The method as in claim 6 wherein the speaker is inserted into the opening with its vertical, elliptical axis oriented perpendicular to the panel and its horizontal elliptical axis oriented vertically along the panel.

8. The method as in claim 6 wherein the bridge member and its center section both have vertical and horizontal, elliptical axii which are identical to the vertical and horizontal, elliptical axii of the speaker.

9. The method as in claim 5 further comprising the steps of providing a trim ring and attaching the trim ring to the front surface of the panel to secure the speaker to the panel.

* * * * *